US012084843B2

(12) United States Patent
Song et al.

(10) Patent No.: US 12,084,843 B2
(45) Date of Patent: Sep. 10, 2024

(54) RETAINING MECHANISM FOR TEETH

(71) Applicant: SUNGBO INDUSTRIAL CO., LTD., Incheon (KR)

(72) Inventors: Keun Chul Song, Seoul (KR); Dae Hyun Ryu, Incheon (KR); Hyun Soo Lee, Incheon (KR)

(73) Assignee: SUNGBO INDUSTRIAL CO., LTD., Incheon (KR)

( * ) Notice: Subject to any disclaimer, the term of this patent is extended or adjusted under 35 U.S.C. 154(b) by 251 days.

(21) Appl. No.: 17/396,113

(22) Filed: Aug. 6, 2021

(65) Prior Publication Data

US 2022/0074172 A1 Mar. 10, 2022

(30) Foreign Application Priority Data

Sep. 10, 2020 (KR) ..... 10-2020-0116234

(51) Int. Cl.
*E02F 9/28* (2006.01)

(52) U.S. Cl.
CPC ..... *E02F 9/2841* (2013.01); *E02F 9/2825* (2013.01)

(58) Field of Classification Search
CPC ..... E02F 9/2841; E02F 9/2833; E02F 9/2816; E02F 9/2825
See application file for complete search history.

(56) References Cited

U.S. PATENT DOCUMENTS 3,894,349 A 7/1975 Moreau
4,823,487 A * 4/1989 Robinson ..... E02F 9/2841 403/291
5,852,888 A 12/1998 Cornelius
6,735,891 B2 * 5/2004 Pallas Moreno ..... F16B 19/002 37/457
2004/0060208 A1 4/2004 Wagner
2013/0174453 A1 * 7/2013 Cheyne ..... E02F 9/267 37/456
2016/0083935 A1 * 3/2016 Edmonds ..... E02F 9/2833 37/456
2016/0319520 A1 11/2016 Marchand
(Continued)

FOREIGN PATENT DOCUMENTS

CN 103608527 A 2/2014
DE 2238454 A1 * 2/1974
EP 1710358 A1 10/2006
(Continued)

*Primary Examiner* — Adam J Behrens
*Assistant Examiner* — Blake E Scoville
(74) *Attorney, Agent, or Firm* — NKL LAW; Jae Youn Kim

(57) ABSTRACT

Proposed is a combined structure, and the combined structure includes a coupling target object having a coupling space that comprises a first space and a second space communicating with each other, a damper structure accommodated in the first space and including a flexible portion having a hollow therein and a hard portion coupled to the flexible portion and having one surface exposed to an outside, and a coupling unit accommodated in the second space, a portion of which is in contact with one surface of the hard portion. The hollow is closed from the outside in the damper structure. In response to rotation of the coupling unit in the second space, another portion different from the portion of the coupling unit comes into contact with the hard portion.

7 Claims, 11 Drawing Sheets

(56) References Cited

U.S. PATENT DOCUMENTS

2019/0203445 A1 7/2019 Song et al.

FOREIGN PATENT DOCUMENTS

| | | | | | |
|---|---|---|---|---|---|
| JP | 61225430 | A | * | 10/1986 | |
| JP | H11107329 | A | | 4/1999 | |
| JP | 2011042976 | A | * | 3/2011 | |
| JP | 2016089412 | A | * | 5/2016 | |
| KR | 10-2006-0011366 | A | | 2/2006 | |
| KR | 101817064 | B1 | * | 1/2018 | |
| KR | 10-1911513 | B1 | | 10/2018 | |
| WO | WO-2015010159 | A1 | * | 1/2015 | ..... E02F 9/2841 |

* cited by examiner

RETAINING MECHANISM FOR TEETH

BACKGROUND OF THE DISCLOSURE

Field of the Disclosure

The present disclosure relates to a combined structure and, more particularly, to a combined structure coupled by a damper structure.

Related Art

A digging apparatus such as an excavator used in public works or mines is used to dig earth and stone and pile up the dug earth or stone to other locations or a cargo box of a vehicle.

Such a digging apparatus generally has a bucket coupled to a mechanical arm and used to dig and carry earth or stone.

The end of the bucket is equipped with a plurality of tooth points which are used to dig and crush earth or stone.

Here, the tooth points are connected to the bucket via a tooth adapter connected to the bucket, and thus, the plurality of tooth points are substantially connected to the tooth adapter.

Here, the tooth point and the tooth adapter may be coupled to each other through a coupling unit in the form of a pin. Here, a damper portion is positioned in a coupling space of one of the tooth point and the tooth adapter to control a coupling operation of the coupling unit to fix a coupled state.

When a direct excavation operation such as digging an excavation spot and scooping up soil and stones is made by such an excavator, foreign substances such as soil are introduced into the coupling space where the coupling unit is positioned, and the introduced foreign substances are not smoothly discharged.

Thus, a coupling space sufficient to smoothly operate the coupling unit is not secured, the coupling unit is not smoothly operated, and there are many difficulties in inserting and separating the coupling unit.

RELATED ART DOCUMENT

Patent Document

Korean Patent Application Publication No. 10-2006-0011366

SUMMARY

An aspect of the present disclosure is to facilitate a coupling operation of different coupling target objects.

Another aspect of the present disclosure is to increase the lifespan of a component that performs a coupling operation of different coupling target objects.

In one general aspect of the present disclosure, there is provided a combined structure and the combined structure includes: a coupling target object having a coupling space that comprises a first space and a second space communicating with each other, a damper structure accommodated in the first space and comprising a flexible portion having a hollow therein and a hard portion coupled to the flexible portion and having one surface exposed to an outside, and a coupling unit accommodated in the second space, a portion of which is in contact with one surface of the hard portion. The hollow is closed from the outside in the damper structure. In response to rotation of the coupling unit in the second space, another portion different from the portion of the coupling unit comes into contact with the hard portion. When the coupling unit rotates in one direction from an initial state, in which the coupling unit is inserted into the second space, to become a first rotation state, a portion where the coupling unit and the hard portion contact each other is moved in a direction toward the flexible portion further than the initial state, and thus, the hard portion is moved in the direction toward the flexible portion further than the initial state. The flexible portion is compressed and deformed between the hard portion and an inner surface of the coupling target object forming the first space.

The damper structure may include a coupling surface coupled to the hard portion, a support surface positioned on an opposite side of the coupling surface, and a connection surface connecting the coupling surface and the support surface. The support surface and the connection surface may be in contact with the inner surface of the coupling target object forming the first space.

At least a part of an externally exposed portion of the coupling surface may be in contact with the inner surface of the coupling target object forming the first space.

The flexible portion may be in contact with the inner surface of the coupling target object forming the first space.

When the coupling unit further rotates in the one direction in the first rotation state to become a second rotation state, the portion where the coupling unit and the hard portion contact each other is moved in a direction toward the coupling unit further than in the first rotation state, the hard portion is moved in a direction toward the coupling unit further than in the first rotation state, and thus, at least a part of the flexible portion is restored from being compressed and deformed in the first rotation state.

A shape of the flexible portion may be deformed to reduce a volume of the hollow, and, when an external force applied to the hard portion is reduced by rotation of the coupling unit in a state in which the volume of the flexible portion is reduced, a volume of the hollow may be restored.

At least one side of the hollow may be formed open, and the damper structure may further include a sealing portion blocking an open side of the hollow.

The coupling target object may be a tooth point of an excavator, and the coupling unit may couple the coupling target object with a tooth adapter.

BRIEF DESCRIPTION OF THE DRAWINGS

FIGS. 8A to 8C are cross-sectional views of a first coupling hole when a coupling unit is inserted into the first coupling hole in which a damper structure is positioned according to an embodiment of the present disclosure, wherein FIG. 8A is a view immediately after the coupling unit is inserted, FIG. 8B is a view of a process in which the coupling unit is rotated in a direction corresponding to fastening of the coupling unit, and FIG. 8C is a view illustrating a state in which the coupling unit is rotated in the direction corresponding to fastening of the coupling unit.

DESCRIPTION OF EXEMPLARY EMBODIMENTS

Figure 1:
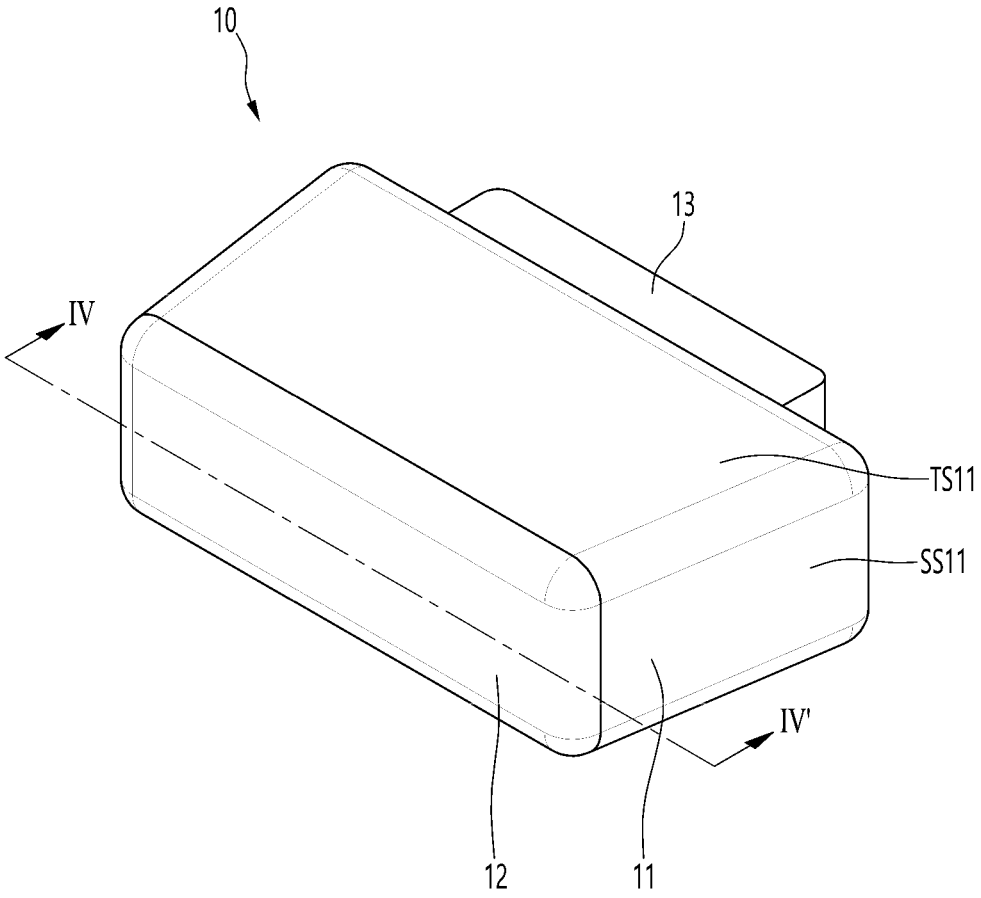
FIG. 1 is a perspective view of a damper structure according to an embodiment of the present disclosure.

Hereinafter, embodiments of the present disclosure will be described in detail with reference to the accompanying drawings. In describing the present disclosure, if it is determined that a detailed description of known functions and components associated with the present disclosure unnecessarily obscure the gist of the present disclosure, the detailed description thereof will be omitted. The terms used henceforth are used to appropriately express the embodiments of the present disclosure and may be altered according to a person of a related field or conventional practice. Therefore, the terms should be defined on the basis of the entire content of this specification.

Technical terms used in the present specification are used only in order to describe specific exemplary embodiments rather than limiting the present disclosure. The terms of a singular form may include plural forms unless referred to the contrary. It will be further understood that the terms "comprise" and/or "comprising," when used herein, specify the presence of stated features, integers, steps, operations, elements, and/or components, but do not preclude the presence or addition of one or more other features, regions, integers, steps, operations, elements, components, and/or groups thereof.

Hereinafter, a damper structure and a combined structure having the same according to an embodiment of the present disclosure will be described with reference to the accompanying drawings.

In the present specification, the damper structure according to an embodiment of the present disclosure is illustrated and described with an example in which the damper structure is mounted on a tooth for a bucket of an excavator, but aspects of the present disclosure are not limited thereto.

Referring to FIGS. 1 to 4, a damper structure 10 of this example may have a flexible portion 11 having a hollow H111 therein, a sealing portion 12 coupled to the flexible portion 11, and a hard portion 13 coupled to the flexible portion 11 and having one surface (e.g., a rear surface) exposed to the outside.

Here, the flexible portion 11 and the hard portion 13 may be coupled to each other.

Thus, when an external force, i.e. external pressure, is applied to the hard portion 13, a shape of the flexible portion 11 may be deformed and a volume of the hollow H111 may be reduced.

Accordingly, the coupling unit inserted into an overlapping portion of the two different coupling target objects in order to couple the two different coupling target objects to each other may maintain or release a coupled state of the two coupling target objects depending on whether a position in contact with the damper structure 10 is changed due to a state change of the damper structure 10 by the external pressure.

The hollow H111, which is positioned at the flexible portion 11 and whose volume changes depending on the external pressure, may be positioned between the flexible portion 11 and the sealing portion 12, and the flexible portion 11 may be blocked by the sealing portion 12 and thus may be blocked in the damper structure 10 from the outside and closed from the outside.

The flexible portion 11 is formed of an elastic material such as a rubber material or an elastomer having elasticity such as silicone.

Therefore, as already described, when external pressure is applied from the hard portion 13, the flexible portion 11 causes the position of the hard portion 13 to be moved toward the sealing portion 12 due to shape deformation by compression.

In addition, when the external pressure applied to the hard portion 13 is released, the flexible portion 11 that has been compressed may be restored by a restoring force to an initial state thereof, and such a restoration operation of the flexible portion 11 may cause the hard portion 13 to return to an initial position thereof.

Figure 2:
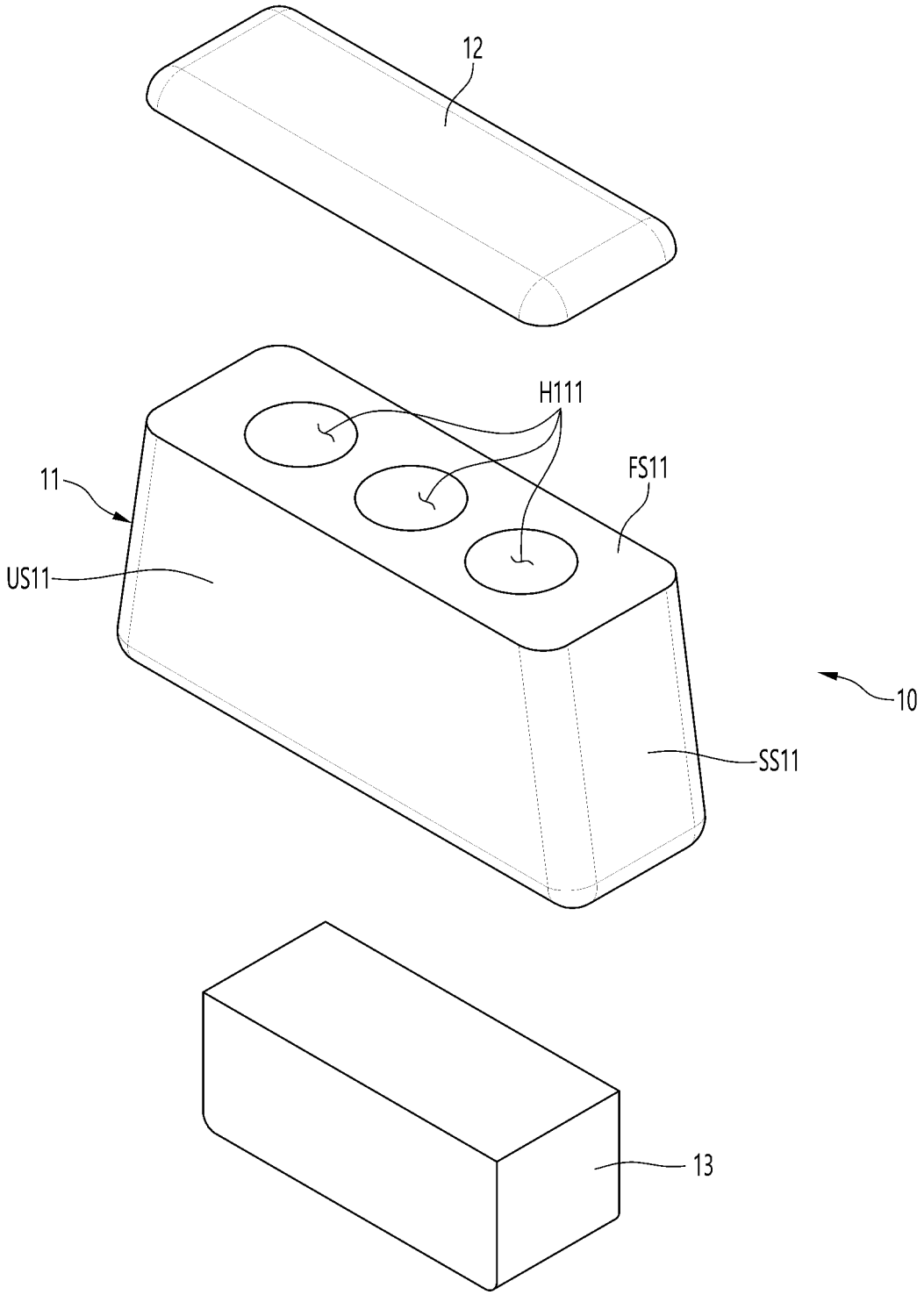
FIGS. 2 and 3 are exploded perspective views of the damper structure shown in FIG. 1 as viewed in different directions.
Figure 3:
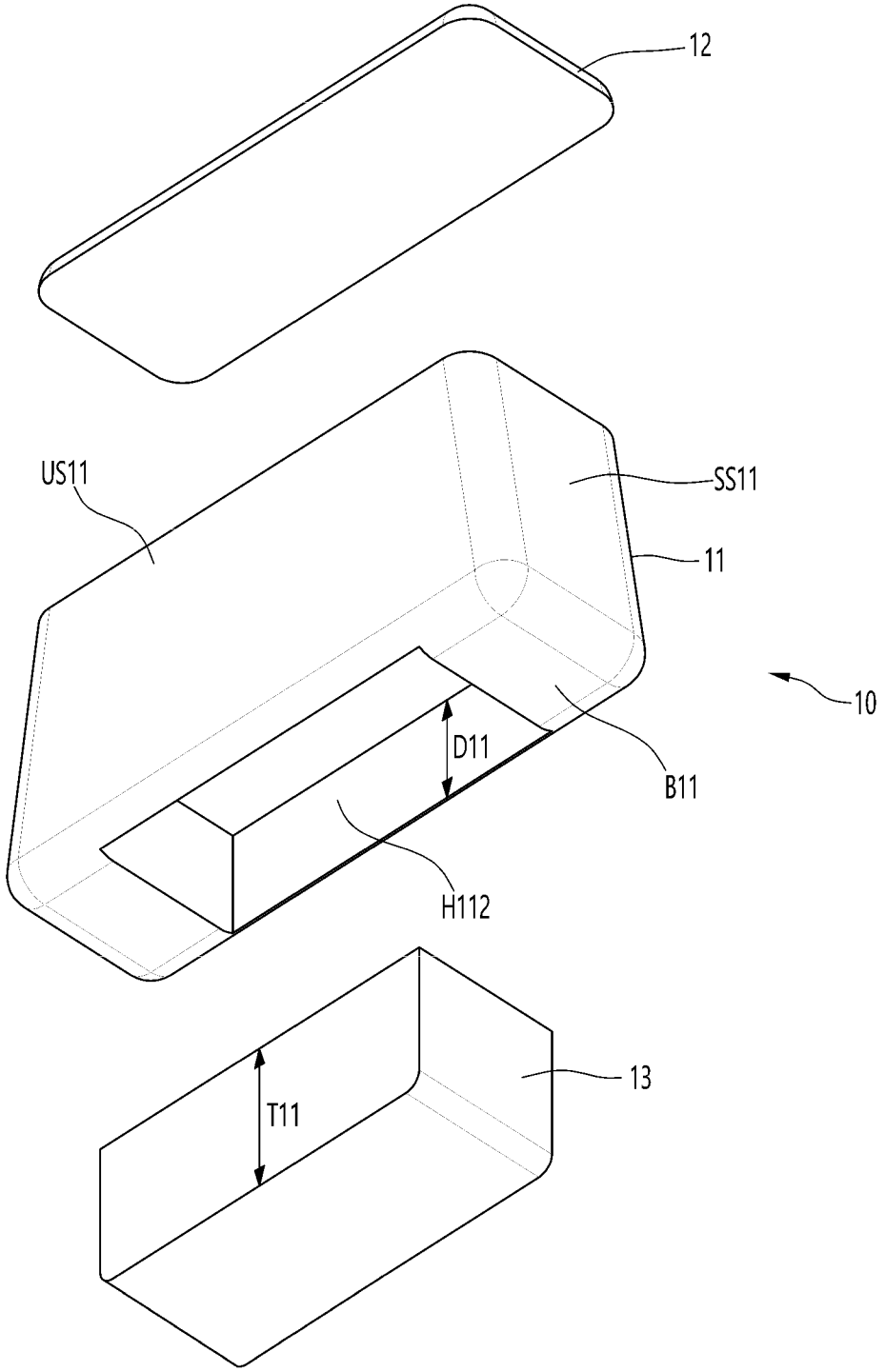
Figure 4:
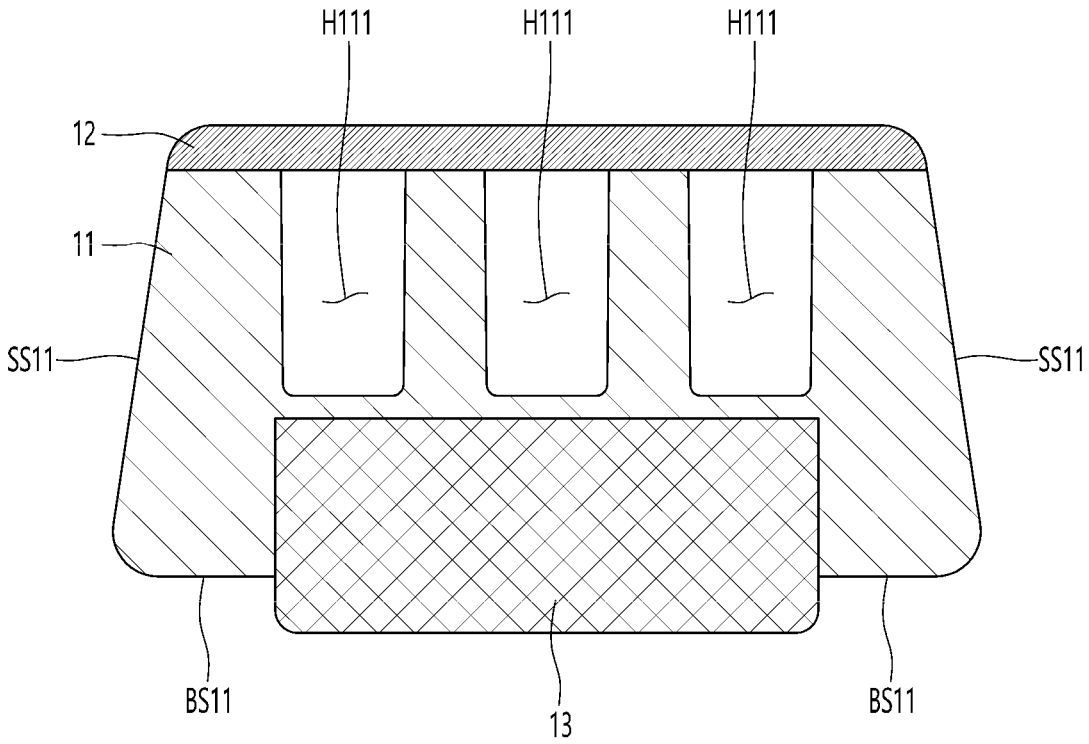
FIG. 4 is a cross-sectional view of the damper structure shown in FIG. 1, as taken along line IV-IV.

The flexible portion 11 may have a substantially hexahedral shape, such as a rectangular parallelepiped shape, as shown in FIGS. 2 and 3, and or may be provided with an insertion groove H112 for coupling of at least one hollow (e.g., three hollows) H111 and the hard portion 13.

Accordingly, the flexible portion 11 may have a rear surface BS11, which is one side of the flexible portion 11 coupled to the hard portion 13, a front surface FS11 which is the other side facing the rear surface B11 from the opposite side of the rear surface B11, two side surfaces SS11 connecting the rear surface BS11 and the front surface FS11, and an upper surface TS11 and a lower surface US11 positioned at an upper side and a lower side of the flexible portion 11, respectively.

Each hollow H111 may extend from the front surface FS11 to the rear surface BS11 side (i.e, one direction), and a plurality of hollows H111 may be arranged to be spaced apart from each other along a direction (i.e., the other direction) of the both side surfaces SS11 that crosses a direction in which the rear surface BS11 or the front surface FS11 extends.

Since this hollow H111 is not a hole completely penetrating the flexible portion 11, one end of each hollow H111, i.e. a part facing the sealing portion 12, may be open and the other end may be blocked by the flexible portion 11.

A plurality of hollows H111 may all have the same shape and size or may be different in at least one of the shape and size.

In addition, the position of the hollow H111 is not limited to this example and the hollow H111 may be located at another position in the flexible portion 11, and the hollow H111 may be a sealed space in which all parts are not opened but blocked by the flexible portion 11.

The insertion groove H112 may be positioned in at least a portion of the rear surface BS11 of the flexible portion 11.

In this example, the insertion groove H112 may be positioned only at a portion of the middle of the rear surface BS11 of the flexible portion 11, so the insertion groove H112 may not be positioned at both sides of the rear surface BS11 of the flexible portion 11.

Thus, a height of the rear surface BS11 of the flexible portion 11 may vary depending on a position, and both sides around the insertion groove H112 may have a higher height than that of a part at which the insertion groove H112 is positioned.

The insertion groove H112 is a portion into which at least a part of the hard portion 13 is inserted, and the shape of the insertion groove H112 may be determined by a shape of the inserted part of the hard portion 13. For example, the insertion groove H112 may be a groove having a rectangular planar shape.

In this example, a depth D11 of the insertion groove H112 is smaller than a thickness T11 of the hard portion 13, so a part of the hard portion 13 may be inserted into the insertion groove H112, but the remaining part may protrude to the outside. Thus, a part of the hard portion 13 is inserted into the flexible portion 11 and the remaining part protrudes from the flexible portion 11 so that the remaining part of the hard portion 13 may be exposed to the outside.

However, aspects of the present disclosure are not limited thereto, and the depth D11 of the insertion groove H112 may be equal to or greater than the thickness T11 of the hard portion 13, and, in this case, the hard portion 13 is entirely positioned within the insertion groove H112 without any portion protruding to the outside, so that only one surface of the hard portion 13 may be exposed to the outside. Accordingly, as external pressure is applied to the externally exposed surface of the hard portion 13, a size of the hollow H111 of the flexible portion 11 may be changed.

The sealing portion 12 may have a hexahedral shape, for example, a plate shape having a rectangular planar shape, as shown in FIGS. 2 and 3.

The sealing portion 12 may be positioned in contact with a corresponding surface (e.g., the front surface FS11) of the flexible portion 11 and thus coupled to the flexible portion 11. Here, the sealing portion 12 may be coupled to the corresponding surface of the flexible portion 11 using an adhesive or the like.

Due the coupling of the sealing portion 12, an open side of each hollow H111 is blocked by the sealing portion 12.

However, in an alternative example, the coupling of the sealing portion 12 and the flexible portion 11 may be made in various ways, such by a fitting operation using a protrusion instead of using an adhesive, and accordingly, the structure of the sealing portion 12 may also vary.

The sealing portion 12 may be formed of a material harder than that of the flexible portion 11, such as a metal material or a ceramic material. Accordingly, when external pressure is applied to the hard portion 13, the flexible portion 11 is compressed and then restored as described above, whereas the sealing portion 12 may be relatively less deformed or may not be deformed.

However, in an alternative example, the sealing portion 12 may be, like the flexible portion 11, formed of a flexible material which is capable of being easily deformed in shape by external pressure, and, in this case, the sealing portion 12 may be formed of the same material as that of the flexible portion 11.

In another alternative example, the sealing portion 12 may be omitted, and, in this case, a corresponding side of the flexible portion 11 (e.g., the front surface FS11) may be directly in contact with a corresponding portion of a corresponding coupling target object and may serve as a surface supporting the damper structure 10.

Accordingly, when pressure is applied from the hard portion 13, pressure is also applied to the flexible portion 11 formed of an elastic material, and the magnitude of the pressure applied to the flexible portion 11 is increased more than in an initial state.

Due to this application of the pressure, the part of the flexible portion 11 in contact with each hollow H111, i.e. a bottom surface of each hollow H111, may be pushed up into a corresponding hollow H111.

As such, as the pressure applied toward the hollow H111, which is an empty space, increases, shape deformation and positional movement of parts adjacent to the hollow H111 in the flexible portion 11 may occur, and, due to the change in the flexible portion 11, the hard portion 13 may be pushed toward the flexible portion 11 and the sealing portion 12, thereby causing the positional movement. In this case, an amount of shape deformation and positional movement of the flexible portion 11 may be determined according to a magnitude of the external pressure applied to the hard portion 13.

The hard portion 13 has a shape of a substantially hexahedron (e.g., a cuboid) as shown in FIGS. 2 and 3, and, as already described, a part of the hard portion 13 is inserted into the insertion groove H112 positioned d at the rear surface BS11 of the flexible portion 11 and the remaining part protrudes to the outside.

The hard portion 13 may be formed of a material having good durability such as water-resistance and wear-resistance, such as a metal material or a ceramic material. Thus, the hard portion 13 may be strong against moisture and may be safe from damage or breakage by a force applied from the outside.

This damper structure 10 may be, as already described, applied to control an operation of a coupling unit that couples different coupling target object, for example, a tooth point in a tooth for a bucket of an excavator and a tooth adapter inserted into the tooth point.

Accordingly, the damper structure 10 of this example may be positioned in a coupling space in which the coupling unit is inserted to rotate in a predetermined direction according to a coupling operation and a releasing operation. In this case, the coupling space may be positioned at the tooth point.

Thus, the damper structure 10 positioned in the coupling space may be positioned in contact with the coupling unit that is inserted in a direction crossing the tooth point and the tooth adapter inserted in the tooth point, and a physical force, i.e. external pressure, may be applied to or released from the hard portion 13 of the damper structure 10 in response to a rotational operation of the coupling unit in contact therewith.

Next, an example of the tooth 1 for the bucket to which the damper structure 10 of this example is mounted will be described with reference to FIGS. 5 to 8.

Figure 5:
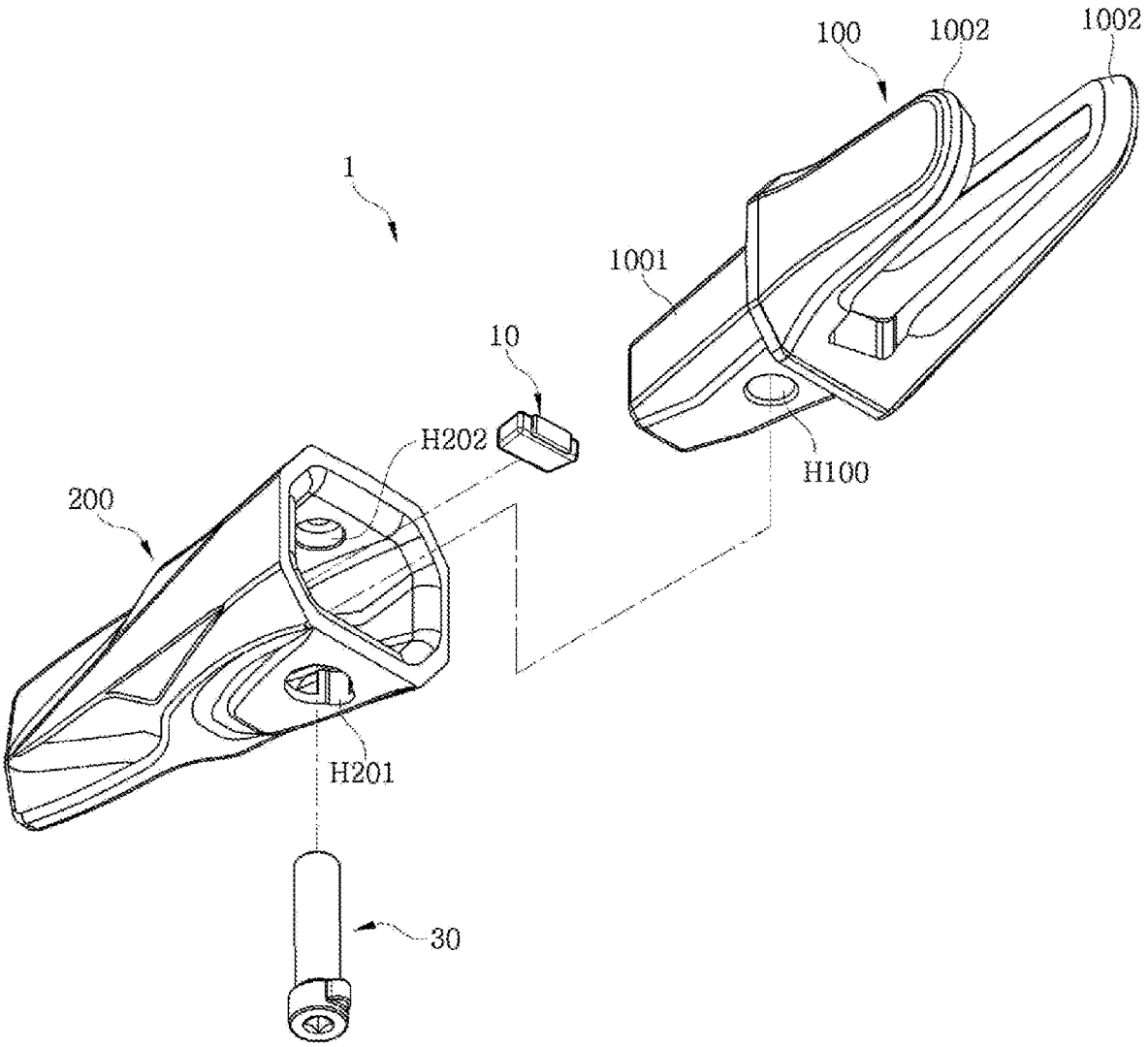
FIG. 5 is an exploded perspective view of an example of a tooth for a bucket of an excavator to which a damper structure according to an embodiment of the present disclosure is applied.

Referring to FIGS. 5 and 6, the tooth 1 for a bucket of an excavator (i.e. a combined body) of this example has a tooth adapter (e.g., a first coupling target object) to be coupled to a bucket (not shown) of an excavator 100, a tooth point (e.g., a second coupling target object) 200 coupled to the tooth adapter 100, and a coupling unit 30.

One side of the tooth adapter 100 may be coupled to the tooth point 200 and the other side thereof may be coupled to the bucket (not shown) of the excavator.

Accordingly, one side of the tooth adapter 100 may be provided with a coupling portion 1001 that is a protruding portion for coupling with the tooth point 200, and an insertion portion 1002 formed in the other side to protrude for coupling with the bucket may be provided.

A coupling hole H100 through which the coupling unit 30 is inserted may be provided in surfaces (e.g., the upper surface and the lower surface) opposed to each other in the coupling portion 1001.

The tooth point 200 is coupled to the tooth adapter 100 to excavate an excavation spot.

As shown in FIG. 5, the tooth point 200 may be provided in the middle with a space where the coupling portion 1001 of the tooth adapter 100 is inserted, i.e. an insertion space, and may be provided with two coupling holes (e.g., the first coupling hole and a second coupling hole) H201 and H202 which are positioned at opposite sides (e.g., the lower surface and the upper surface) to each other so that the coupling unit 30 can be inserted thereinto.

Here, when the coupling portion 1001 of the tooth adapter 100 is inserted into the insertion space, the two coupling holes H201 and H202 may be positioned on a straight line with the coupling hole H100 provided in the tooth adapter 100, so that the coupling unit 30 is inserted into the coupling hole H100 positioned at the tooth adapter 100 and the coupling holes H201 and H202 positioned at the tooth point 200. At least some of these coupling holes H100, H201, and H202 may be penetrated by the coupling unit 30.

In this example, the damper structure 10 may be positioned in the first coupling hole H201 positioned at one surface (e.g., the lower surface) of the tooth point 200 out of the first coupling hole H201 and the second coupling hole H202, and a rotational operation of the coupling unit 30 inserted adjacent to the damper structure 10 may be performed.

Figure 7:
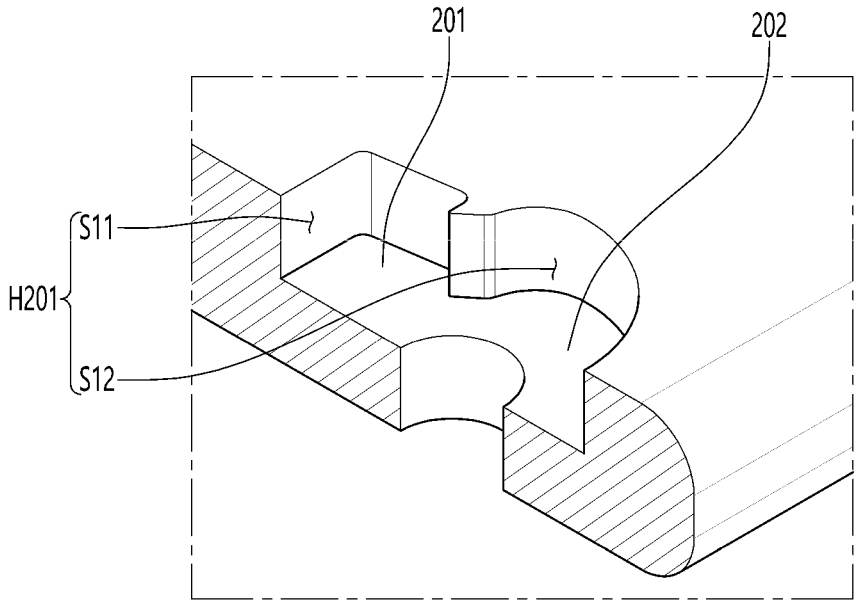
FIG. 7 is a partially enlarged view of a first coupling hole shown in FIG. 5.

Thus, as shown in FIG. 7, a portion of the tooth point 200 in contact with the first coupling hole H201, i.e. a portion of the tooth point 200 forming the first coupling hole H201, may be provided a support 201, where the damper structure 10 is positioned, and a guide portion 202 which is a surface guiding a rotational operation of the coupling unit 30.

As shown in FIG. 7, the support 201 may be positioned at an inner surface of the tooth point 200 in the first coupling hole H201 (i.e. a surface into which the first coupling hole H201 is in contact). Accordingly, at least a portion of the lower surface of the damper structure 10 is positioned at the support 201, so that the damper structure 10 inserted into the first coupling hole H201 may be seated on the support 201 without being pulled out to the outside. In this case, the upper surface of the damper structure 10 may be exposed within the first coupling hole H201 without contacting any portion of the tooth point 200 in contact with the first coupling hole H201.

In this case, the hard portion 13 of the damper structure 10 may be positioned adjacent to the coupling unit 30, and thus, one surface of the hard portion 13 exposed to the outside may be opposed to the coupling unit 30 to come into contact with a corresponding portion of the coupling unit 30.

A shape of the first coupling hole H201 may be determined depending on shapes of the damper structure 10 and the coupling unit 30 positioned therein.

The coupling unit 30 inserted into the plurality of coupling holes H100, H201, and H202 positioned at the tooth adapter 100 and the tooth point 200 to fix the tooth adapter 100 inserted into the insertion space of the tooth point 200 may have various structures.

Figure 6A:
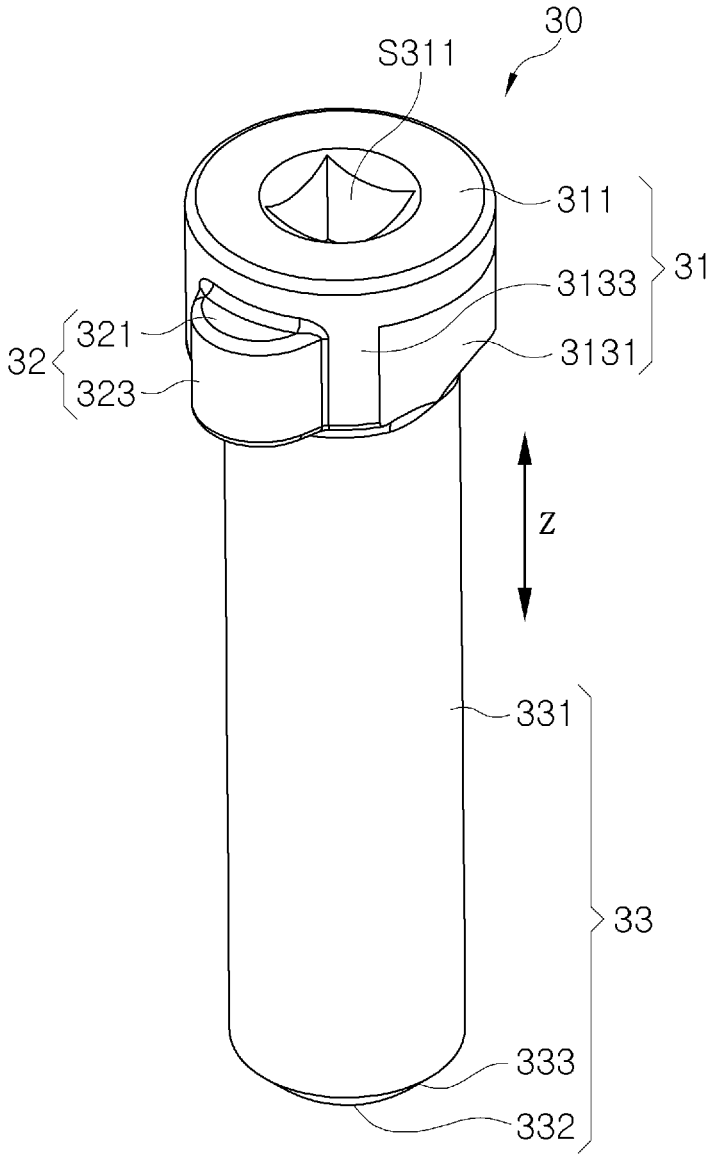
FIGS. 6A to 6C are perspective views of the coupling unit shown in FIG. 5 as viewed in different directions, respectively.
Figure 6B:
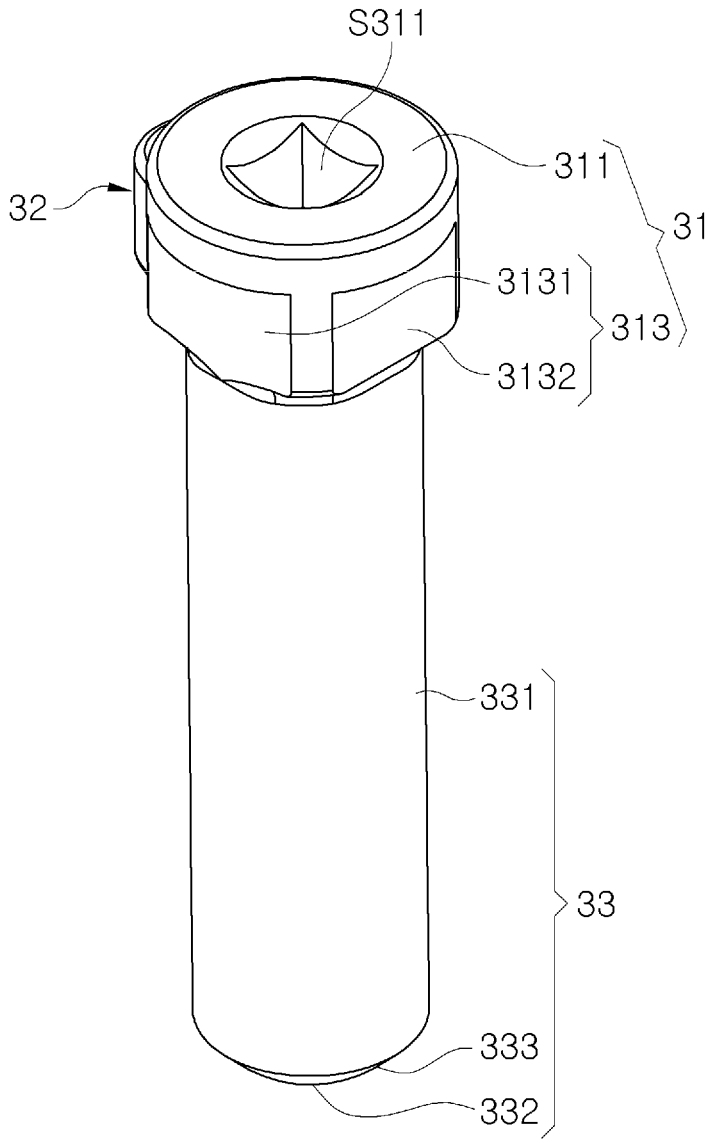

An example of the coupling unit 30 is shown in FIGS. 6A and 6B.

The coupling unit 30 shown in FIGS. 6A to 6B may be in the form of a pin.

Accordingly, when the coupling portion 1001 of the tooth adapter 100 is inserted into the insertion space of the tooth point 200, the coupling unit 30 may be inserted into the first coupling hole H201 and the second coupling hole H202 positioned at the tooth point and two insertion holes H100 positioned at the tooth adapter 100 to cross a portion where the tooth adapter 100 and the tooth point 200 are overlapped with each other.

The coupling unit 30 may be formed of a metal material having good durability, such as stainless steel.

Specifically, the coupling unit 30 is provided with a coupling portion 31, a protrusion 32 protruding outward from the coupling unit 31, and an insertion portion 33 extending from the coupling portion 31 in one direction Z which is a longitudinal direction of the coupling unit 30.

In this example, the coupling portion 31 may be inserted into the first coupling hole H201 and positioned in the first coupling hole H201.

The coupling portion 31 includes an upper surface 311 having a circular planar shape, a lower surface 312 positioned on the opposite side of the upper surface 311, a side surface 313 connecting the upper surface 311 and the lower surface 312 and parallel to one direction Z.

The upper surface 311 has a square recess S311 positioned at the center thereof and having an empty space in a rectangular planar shape. In this case, the square recess S311 has a predetermined depth.

The square recess S311 is a portion into which a device such as a square wrench is inserted when the coupling unit 30 is to be inserted into the first coupling hole H201 and the second coupling hole H202. Here, an operator may insert the corresponding device into the square recess S311, strike a head portion of the corresponding device with a hammer, or the like, to insert the coupling unit 30 into the first coupling hole H201 and the second coupling hole H202, and subsequently rotate the coupling unit 30 in a predetermined direction, thereby performing the operation of inserting and coupling to the first coupling hole H201 and the second coupling hole H202.

Accordingly, since a cross-sectional shape of the recess S311 has an angulated shape, such as a square shape, or the like, a rotational operation in a corresponding direction may be easily performed.

However, the cross-sectional shape of the recess S311 is not limited to the square shape but may be a polygon such as a hexagon, or the like, depending on the type of equipment in use, and at least one surface thereof may be a curved surface.

The side surface 313 of the coupling portion 31 may be provided with first and second flat surface portions 3131 and 3132 cut in one direction from the lower surface 312 to the upper surface 311 to be flat and a curved surface portion 3133 positioned between the first and second flat surface portions 3131 and 3132.

Here, the first and second flat surface portions 3131 and 3132 are positioned adjacent to each other and positioned up to a predetermined distance from the lower surface 312.

In this example, an angle formed by the two adjacent flat surface portions 3131 and 3132 may be approximately 90 degrees.

Further, a curved surface may be formed between two adjacent flat surface portions.

Thus, the side surface 313 of the coupling portion 31 may include a first portion (i.e., the circular portion) positioned in an upper portion adjacent to the upper surface 311 and curved in every portion, a second portion including the first and second flat surface portions 3131 and 3132, and the curved surface portion 3133.

As already described, the planar shape of the first portion may be circular, and the planar shape of the second portion may have a shape in which two rectilinear portions connected to each other and one curved portion. Here, a portion between the two rectilinear portions adjacent to each other in the second portion may also be curved.

Thus, an engagement protrusion P311, which is a lower surface of the exposed first portion, may be positioned between the second portion where the first and the second flat surface portions 3131 and 3132 are positioned and the first portion.

The insertion portion 33 may have a cylindrical shape having a circular planar shape.

Accordingly, the insertion portion 33 may have a side surface 331 connected to the lower surface of the coupling portion 31 to extend in a cylindrical shape and a lower surface 332.

Here, a diameter of the side surface 331 is smaller than a diameter of the upper surface 311 of the coupling portion 31, but larger than a diameter of the lower surface 332. Accordingly, a sloped surface 333 is provided between the side surface 331 and the lower surface 332.

The protrusion 32 protrudes outward from the curved surface portion 3133 of the side surface 313 of the coupling portion 31.

Figure 6C:
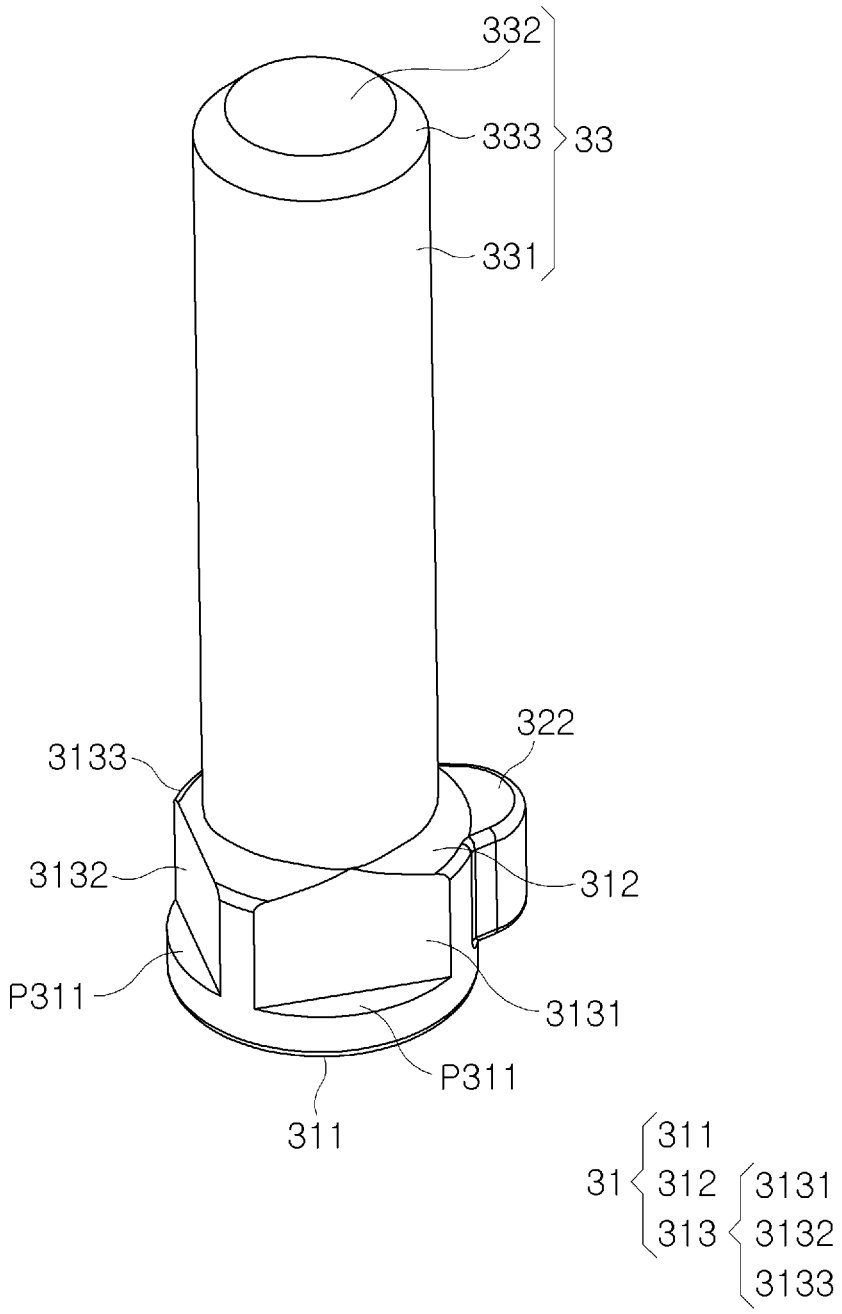

The protrusion 32 of this example, as shown in FIGS. 6A to 6C, may be provided with an upper surface 321, a lower surface 322 positioned on the opposite side of the upper surface 321, and a side surface 323 disposed between the upper surface 321 and the lower surface 322.

In this case, the upper surface 321 may be flat or may have a groove recessed in the middle thereof.

The upper surface 321 of the protrusion 32 may be positioned in contact with the guide portion 202, and thus, in response to a rotational operation of the coupling unit 30, the protrusion 32 may be moved in a corresponding direction along a surface of the guide portion 202.

The guide portion 202 may be a sloped surface.

A height of the lower surface 322 of the protrusion 32 may be equal to a height of a lower surface of the first portion, i.e. a position of the engagement protrusion P311, but a corner where the lower surface 322 and the side surface 323 meet each other is may be chamfered.

The side surface 323 may be formed of a single curved surface. As such, a curvature of the side surface 323 formed of the curved surface is smaller than a curvature of the upper surface of the coupling portion 31.

Thus, as shown in FIGS. 6A and 6C, the planar shape of the upper surface 321 and the lower surface 322 of the protrusion 32 may have a bow shape, and a thickness of the protrusion 32 vary depending on a position. That is, the thickness of the protrusion 32 may increase in a direction from an edge of the protrusion 32 in contact with the coupling portion 31 along the side surface 323 toward the middle of the protrusion 32.

As such, the side surface 323 of the protrusion 32, i.e. a portion facing a second space S12 which is a corresponding space of the first coupling hole H201 where the coupling portion 31 is positioned, may be a curved surface.

Therefore, since the side surface 323 of the protrusion 32 in contact with the adjacent damper structure 10 and applying pressure to the damper structure 10 is not a flat surface but a curved surface, pressure applied to the corresponding portion of the damper structure 10 in contact with the coupling unit 30, i.e. the hard portion 13, increases, thereby improving a coupling force of the coupling unit 30.

Accordingly, a coupling force between the tooth adapter 100 and the tooth point 200 is further improved than in a case where the side surface of the protrusion is a flat surface.

The protrusion 32 may serve as a fixing latch for stably positioning the coupling unit 30 in the first coupling hole H201 after the coupling unit 30 is inserted into the first coupling hole H201 and the second coupling hole H202.

As such, since a structure of a portion (i.e. the coupling portion 31) of the coupling unit 30 to be inserted into the first coupling hole H201 and a structure of a portion (i.e. the insertion portion 33) of the coupling unit 30 to be inserted into the second coupling hole H202 are different from each other, the first coupling hole H201 and the second coupling hole H202 into which the one coupling unit 30 is inserted may have different structures from each other.

Accordingly, the first coupling hole H201 may be a portion where the coupling unit 30 is primarily inserted and coupling between the protrusion 32 and the damper structure 10 is made by a rotational operation of the inserted coupling unit 30.

Accordingly, the damper structure 10, and the coupling portion 31 and the protrusion 32 of the coupling unit 30 are positioned in the first coupling hole H201, and the first coupling hole H201 may be a space where a coupling operation to couple the tooth adapter 100 and the tooth point 20 is performed.

The second coupling hole H202 is a portion where the coupling unit 30 inserted into the first coupling hole H201 is secondarily inserted to complete the coupling of the tooth adapter 100 and the tooth point 200, which are partially overlapped with each other in the insertion space.

As such, the first coupling hole H201, which is a coupling space where the operation of coupling the tooth adapter 100 and the tooth point 200 is performed, may be provided with a first space S11 having the damper structure 10 positioned therein and a second space S12 connected to the first space S11 and having the coupling unit 30 positioned therein, as shown in FIG. 7.

Here, the guide portion 202 may be in contact with the second space S12 to serve as a lower end partially blocking a lower portion of the second space S12, and the support 201 may be in contact with the first space S11 to serve as a lower end partially blocking a lower portion of the first space S11.

Figure 8A:
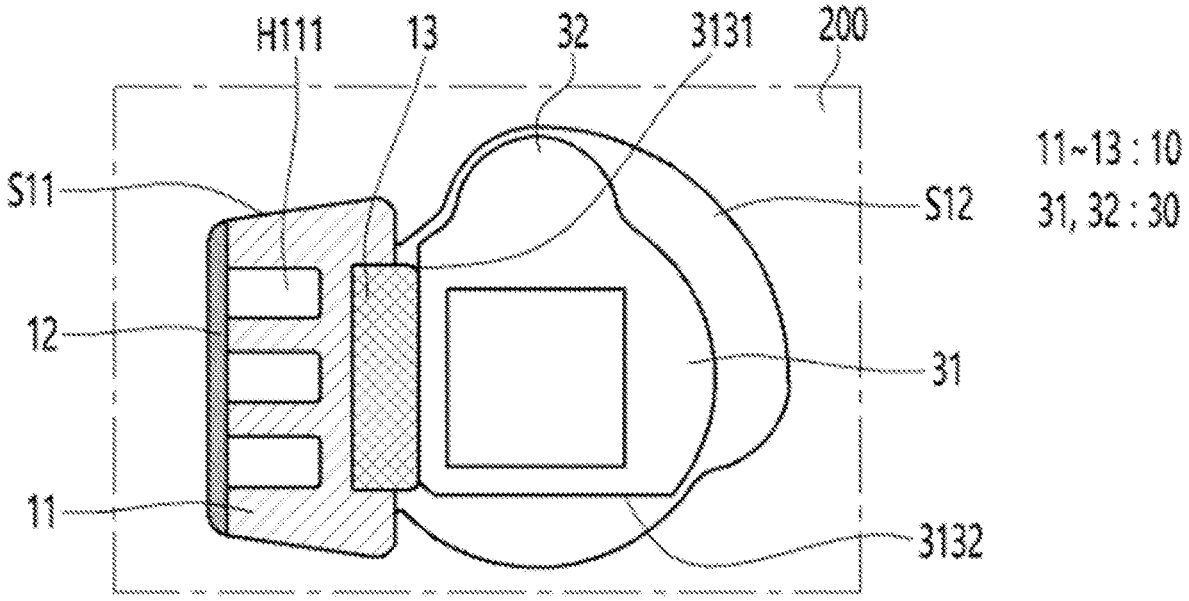
Figure 8B:
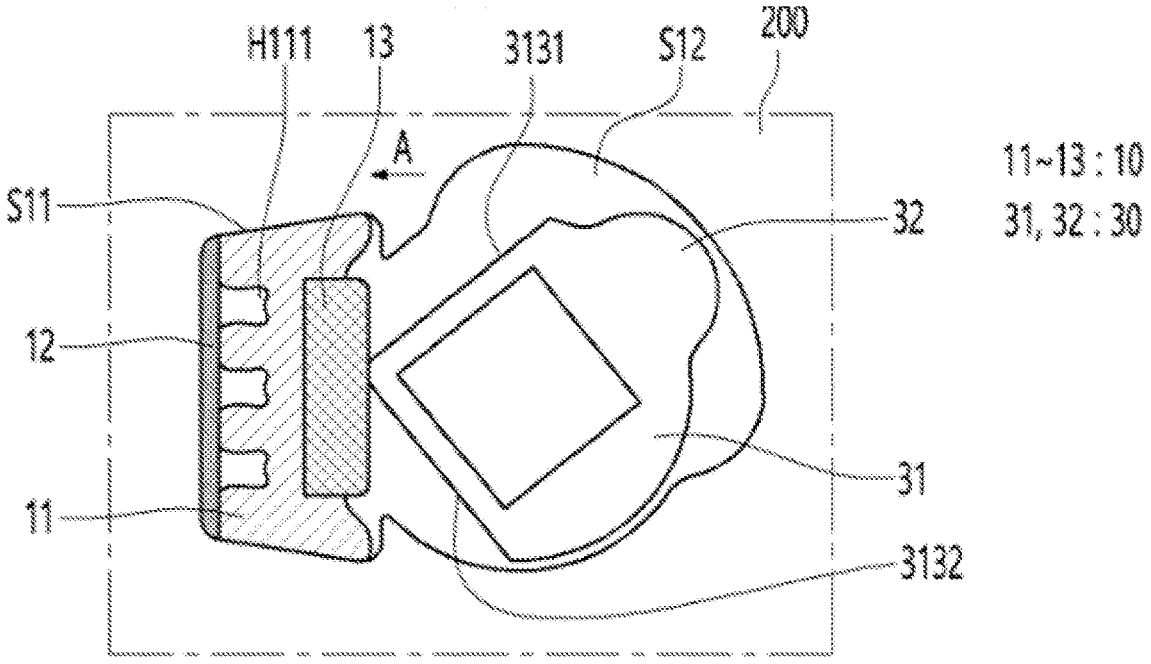
Figure 8C:
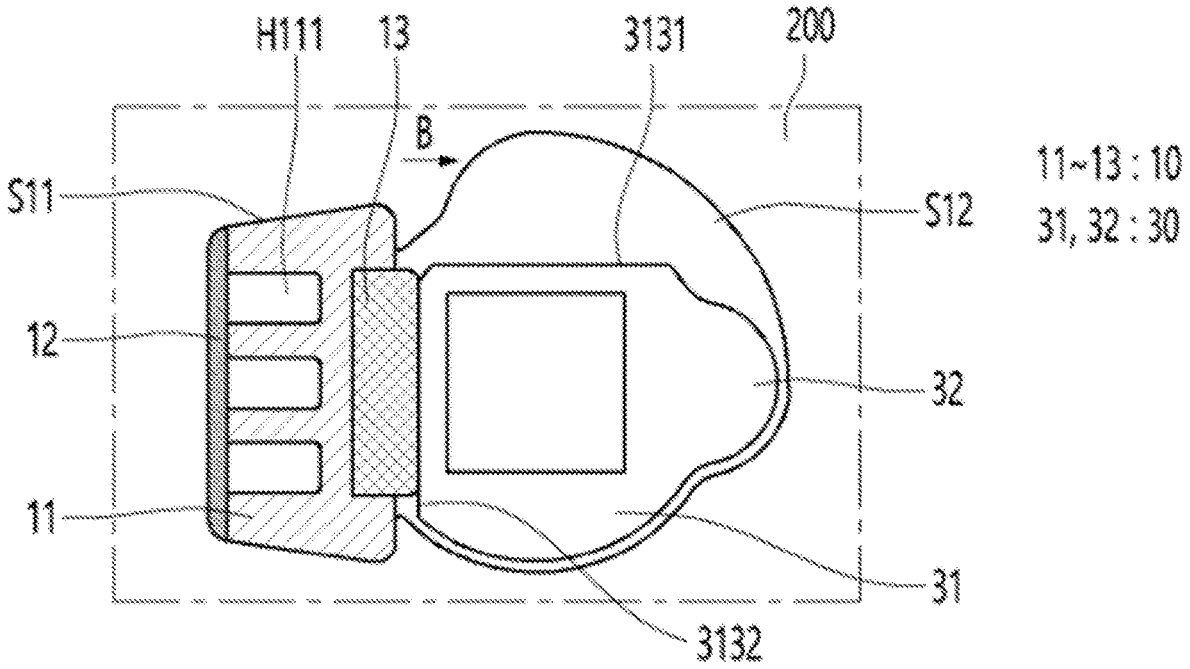

As illustrated in FIGS. 8A to 8C, in the first space S11 where the damper structure 10 is positioned, an outer surface of the flexible portion 11, i.e. the front surface FS 11, the both side surfaces SS11, and the lower surface US11, exposed to the outside in the damper structure 100 and an outer surface of the sealing portion 12 may be positioned in contact with a portion (an inner side surface) forming the first space S11 in the tooth point 200.

Accordingly, an exposed portion of the rear surface BS11 of the flexible portion 11 into which the hard portion 13 is inserted may be positioned at a boundary between the first space S11 and the second space S12.

Thus, the flexible portion 11 and the sealing portion 12 may be in contact with a portion of the tooth point 200 in contact with the first coupling hole H201, and a portion of the hard portion 13 externally exposed to protrude toward the coupling unit 30 may be spaced apart from the corresponding portion of the adjacent tooth point 200 without being in contact therewith.

Here, except for the outer surface BS11 into which the hard portion 13 is inserted and the upper surface TS11, all outer surfaces of the flexible portion 11 (e.g., the both side surfaces SS11, the front surface FS11, and a portion of the rear surface BS11) may be in contact with a portion of the tooth point 200 facing the flexible portion 11, and, except for a surface (e.g., a rear surface of the sealing portion 12) in contact with the flexible portion 11, all exposed outer surfaces of the sealing portion 12 may be in contact with a portion of the tooth point 200 facing the sealing portion 12.

In the damper structure 10 positioned in the first space S11 in which the flexible portion 11 and the sealing portion 12 are coupled to each other, a surface to which the hard portion 13 is coupled, i.e. the rear surface B S11 of the flexible portion 11, may be referred to as a coupling surface of the damper structure 10, a surface positioned on the opposite side of the coupling surface, i.e. the front surface of the sealing portion 12, may be referred to as a support surface of the damper structure 10, and a surface connecting the support surface and the coupling surface, i.e. both side surfaces of each of the flexible portion 11 and the sealing portion 12 positioned on the same line (both side surfaces SS11 of the flexible portion 11, and both side surfaces of the sealing portion 12), may be referred to as a connection surface of the damper structure 10.

In addition, upper and lower sides of a portion surrounded by the coupling surface, the support surface, and the connection surface may be referred to as an upper surface and a lower surface of the damper structure 10, respectively, and the lower surface of the damper structure 10 may be positioned on the support 201 present in the first coupling hole H201.

Accordingly, as shown in FIGS. 8A to 8C, the support surface and the connection surface of the damper structure 10 may be in contact with a portion (i.e. an inner surface) of the tooth point 200 forming the first space S11.

As a result, the inner surface of the tooth point 200 forming the first space S11 of the first coupling hole H201 in which the damper structure 10 is positioned may be substantially in contact with all adjacent surfaces of the damper structure 10, and, in this case, there is almost no empty space between the corresponding surface of the tooth point 200 where the first space S11 is formed and the damper structure 10.

Accordingly, introduction of foreign substances such as soil into the empty space between the damper structure 10 and the tooth point 200 may be greatly reduced.

The first space S11 may be determined according to shapes of the outer surfaces of the flexible portion 11 and the sealing portion 12 coupled to each other.

The second space S12 is a space in which a rotational operation of the coupling portion 31 of the coupling unit 30 is performed as shown in FIGS. 8A to 8C, and the coupling unit 31 rotates in the second space S12. Accordingly, a rotational operation of the protrusion 32 protruding from the coupling portion 31 may be performed in the second space S12 in response to rotation of the coupling portion 31.

Accordingly, the shape of the second space S12 may be determined by the shapes of the coupling portion 31 and the protrusion 32 connected to the coupling portion 31 and a rotation range of the protrusion 32. A part of the insertion portion 33 of the coupling unit 30 may be inserted into the second coupling hole H202 positioned on the opposite side (e.g., the upper surface) of the first coupling hole H201.

Accordingly, the side surface 313 and the lower surface 312 of the coupling unit 30 passing through the first coupling hole H201 may be positioned.

Here, since a diameter of the lower surface 332 of the coupling unit 30, i.e. the insertion portion 33, inserted into the second coupling hole H202 is smaller than a diameter of the second coupling hole H202, the second coupling unit 30 does not pass through the second coupling hole H202 and the second coupling hole H202 may be blocked by the lower surface 332 of the coupling unit 30.

Thus, the coupling unit 30 does not protrude outside the second coupling hole H202, so the tooth for bucket 1 has a beautiful appearance, a risk of accidents due to the protruding coupling unit 30 is prevented, and, introduction of foreign substances such as sand or soil into the second coupling hole H202 is prevented.

In order to couple the tooth adapter 100 and the tooth point 200 to each other using the first coupling hole H201 and the second coupling hole H202 having the above-described structure, the damper structure 10 may be positioned on the support 201 in the first coupling hole H201.

Then, the coupling portion 1001 of the tooth adapter 100 may be inserted into the insertion space of the tooth point 200.

The order of a positioning operation of the damper structure 10 and an insertion operation of the tooth adapter 100 may be changed to each other.

By this insertion operation, the positions of the coupling hole H100 positioned at the tooth adapter 100 and the coupling hole H201 and H202 positioned at the tooth point 200 may be arranged on a straight line. In this state, when the coupling unit 30 rotates in a corresponding direction after being inserted into the coupling holes H201, H100, and H202 arranged on a straight line, a position of the coupling portion 31 of the coupling unit 30 positioned in the first coupling hole H201 may be fixed (see FIGS. 8A to 8C).

That is, since the coupling unit 30 is inserted into the coupling holes H201, H100, and H202 arranged on a straight line in the state as shown in FIG. 8A, an initial arrangement state of the damper structure 10 and the coupling unit 30 in the first coupling hole H201 may be the same as shown in FIG. 8A. Accordingly, as shown in FIG. 8A, the coupling portion 31 of the coupling unit 30 accommodated in the second space S12 may remain in contact with a portion of one surface (i.e. a flat surface) of the hard portion 13 of the damper structure 10, i.e. the first flat surface portion 3131.

In this initial state, when the coupling unit 30 inserted into the first coupling hole H201 rotates in a corresponding direction (e.g., clockwise direction) in the second space S12 for the coupling operation, a portion different from the first flat surface portion 3131, which is a part of the coupling unit 30, for example, a corner of the coupling portion 31 as in FIG. 8B, i.e. a portion where the adjacent first and second flat surface portions 3131 and 3132 meet each other may come into contact with the hard portion 13.

Thus, pressure applied to the hard portion 13 of the damper structure 10 by an edge of the coupling portion 31 of the coupling unit 30 is increased.

Accordingly, the hard portion 13 may be pushed toward the flexible portion 11 from an initial position by the applied pressure, i.e. due to an increase in external pressure.

Due to the pushing of the flexible portion 11, the flexible portion 11 may be compressed between the hard portion 13 and an inner surface of the tooth point 200 forming the first space S11 so that a part of the flexible portion 11 may be pushed into the hollow H111 which is an empty space (see FIG. 8B). Thus, the shape of the flexible portion 11 may be deformed, and the position of the hard portion 13 may be moved due to the shape deformation of the flexible portion 11.

That is, when the coupling unit 30 rotates in one direction (e.g., the clockwise direction) in the initial state, in which the coupling unit 30 is inserted into the second space S12, to become a first rotation state in which one surface of the hard portion 13 and a corner of the coupling portion 31 of the coupling unit 30 are in contact with each other, a portion where the coupling unit 30 and the hard portion 13 are in contact with each other may be moved in a direction A toward the flexible portion 11 further than in the initial state, and thus, the hard portion 13 may be moved in the direction A toward the flexible portion 11 further than in the initial state. By the movement of the hard portion 13, the flexible portion 11 may be compressed and deformed between the hard portion 13 and the inner surface of the coupling target object 200 forming the first space S11.

Thus, a volume of the hollow H111 in the flexible portion 11 is reduced, and consequently a volume of the flexible portion 11 is also reduced.

As a result, when an external force applied to the hard portion 13 by rotation of the coupling unit 30 increases, the shape of the flexible portion 11 may be deformed to reduce the volume of the hollow H111 and also reduce the volume of the flexible portion 11. Here, an amount of the deformation of the flexible portion 11 and an amount of the reduction in volume of the flexible portion 11 may be proportional to a magnitude of external pressure applied toward the hard portion 13.

As the coupling unit 30 rotates by about 90 degrees by deformation and positional movement of the damper structure 10, a corresponding flat surface portion of the coupling unit comes into contact with an exposed surface of the adjacent hard portion 13 and thus the coupling unit 30 comes into a fastened state.

Due to the rotation of the coupling unit 30 by 90 degrees, the external force applied to the hard portion 13 may be reduced to return to an initial state.

When the external force applied to the hard portion 13 is reduced to the initial state, the flexible portion 11 is restored to an initial state thereof so that a portion of the flexible portion 11 pushed into the hollow H111 returns to an initial position, and therefore, the volume of the hollow H111 positioned in the flexible portion 11 may also be restored to an initial state.

Thus, the shape of the flexible portion 11 deformed by the external pressure applied to the hard portion 13 may also be restored, so that the volume of the flexible portion 11 may be restored to an initial state.

Here, in the coupling unit 30, pressure is applied to the flat surface portion of the coupling unit 30 by the restoring force of the flexible portion 11, and thus, the coupled state of the coupling unit 30 is stably maintained.

As such, when the coupling unit 30 further rotates in one direction (e.g., clockwise direction) in the first rotation state to become a second rotation state as shown in FIG. 8C, one surface of the hard portion 13 may come into contact with the second flat surface portion 3132, which is another part of the coupling unit 30.

Here, since the second flat surface portion 3132 is a flat surface, a portion of the coupling unit 30 in contact with one surface of the hard portion 13 may be moved in a direction B toward the coupling unit 30 further than in the first rotation state (i.e. a state in which one surface of the hard portion 13 is in contact with a corner of the coupling unit 30), and thus, the hard portion 13 may be moved in the direction B toward the coupling unit 30 further than in the first rotation state. Accordingly, as the position of the hard portion 13 is moved in the direction B toward the coupling unit 30, at least a part of the flexible portion 11 compressed and deformed in the first rotation state may be restored.

Here, since the hard portion 13 of the damper structure 10 in contact with the coupling unit 30 is formed of a metal material such as stainless steel, wear or deformation does not occur or is greatly reduced.

In a separation operation of the coupling unit 30 inserted into the coupling hole H201, the coupling unit 30 rotates in an opposite direction (e.g., counterclockwise direction) to the direction for coupling (see FIG. 8A), and, in response to such a rotational operation, the coupling unit 30 may be lowered or raised along the guide portion 202, so that a portion of the coupling unit 30 protrudes to the outside. Thus, using the portion of the coupling unit 30 protruding to the outside, an operator is allowed to easily separate the coupling unit 30 from the coupling holes H201, H100, and H202.

The present disclosure has been described with an embodiment in which the first coupling target object and the second coupling target object are the tooth adapter 100 and the tooth point 200, respectively, but the present disclosure is not limited thereto.

According to this characteristic, the damper structure positioned in the coupling space is positioned in contact with an adjacent surface, thereby minimizing occurrence of a space between the damper structure and the adjacent surface.

Thus, a space in which foreign substances such as soil is to be introduced into the coupling space is reduced, and damage to components such as the damper structure and the coupling unit due to the foreign substances introduced into the coupling space is reduced or prevented.

In addition, since the reduction of the coupling space due to the foreign substances is greatly reduced, the coupling unit stably rotates without interference of the foreign substances so that a coupled state or a decoupled state may be easily implemented.

In the above, embodiments of the damper structure of the present disclosure and the combined structure using the same have been described. The present disclosure is not limited to the above-described embodiment and the accompanying drawings, and various modifications and changes may be made in view of the person skilled in the art to which the present disclosure pertains. Accordingly, the scope of the present disclosure should, therefore, be determined by equivalents to the claims, as well as by the claims of the present disclosure.

What is claimed is:

1. A retaining mechanism for teeth, comprising:

a tooth point having a coupling space that comprises a first space and a second space communicating with each other;

a damper structure accommodated in the first space, and comprising a flexible portion having an insertion groove which is positioned on one surface thereof and a hollow therein extending from the one surface to another surface opposite to the one surface and having one side which is open, a hard portion inserted in the insertion groove and having one surface which is a flat surface and is exposed to an outside, and a sealing portion blocking the opened side of the hollow; and a coupling unit accommodated in the second space, a portion of which is in contact with the one surface of the hard portion in an initial state, in which the coupling unit is inserted into the second space, wherein the sealing portion is an element separated from the tooth point, wherein coupling of the flexible portion and the sealing portion is made in a fitting operation using a protrusion, wherein, in response to rotation of the coupling unit in the second space from the initial state, another portion different from the portion of the coupling unit comes into contact with the hard portion, wherein when the coupling unit rotates in one direction from the initial state to become a first rotation state a portion where the coupling unit and the hard portion contact each other is moved in a direction toward the flexible portion further than the initial state, and thus, the hard portion is moved in the direction toward the flexible portion further than the initial state, and wherein the flexible portion is compressed and deformed between the hard portion and an inner surface of the tooth point forming the first space.

2. The retaining mechanism of claim 1, wherein the damper structure comprises:

a coupling surface coupled to the hard portion;

a support surface positioned on an opposite side of the coupling surface; and a connection surface connecting the coupling surface and the support surface, wherein the support surface and the connection surface are in contact with the inner surface of the tooth point forming the first space.

3. The retaining mechanism of claim 2, wherein at least a part of an externally exposed portion of the coupling surface is in contact with the inner surface of the tooth point forming the first space.

4. The retaining mechanism of claim 1, wherein the flexible portion is in contact with the inner surface of the tooth point forming the first space.

5. The retaining mechanism of claim 1, wherein when the coupling unit further rotates in the one direction in the first rotation state to become a second rotation state, the portion where the coupling unit and the hard portion contact each other is moved in a direction toward the coupling unit further than in the first rotation state, the hard portion is moved in a direction toward the coupling unit further than in the first rotation state, and thus, at least a part of the flexible portion is restored from being compressed and deformed in the first rotation state.

6. The retaining mechanism of claim 1, wherein a shape of the flexible portion is deformed to reduce a volume of the hollow, and wherein when an external force applied to the hard portion is reduced by rotation of the coupling unit in a state in which a volume of the flexible portion is reduced, the volume of the hollow is restored.

7. The retaining mechanism of claim 1, wherein the tooth point is a tooth of an excavator, and wherein the coupling unit couples the tooth point to a tooth adapter.

* * * * *